US010066839B2

(12) United States Patent
Lee et al.

(10) Patent No.: US 10,066,839 B2
(45) Date of Patent: Sep. 4, 2018

(54) OVEN

(71) Applicant: SAMSUNG ELECTRONICS CO., LTD., Suwon-si, Gyeonggi-do (KR)

(72) Inventors: Dong Ho Lee, Suwon-si (KR); Cheol Eun Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 266 days.

(21) Appl. No.: 14/729,418

(22) Filed: Jun. 3, 2015

(65) Prior Publication Data

US 2016/0025352 A1 Jan. 28, 2016

(30) Foreign Application Priority Data

Jul. 23, 2014 (KR) ..... 10-2014-0093416

(51) Int. Cl.

| | |
|---|---|
| ***H05B 6/10*** | (2006.01) |
| ***F24C 15/00*** | (2006.01) |
| ***F24C 15/08*** | (2006.01) |
| ***H05B 6/64*** | (2006.01) |

(52) U.S. Cl.

CPC ..... *F24C 15/006* (2013.01); *F24C 15/08* (2013.01); *H05B 6/6402* (2013.01); *H05B 6/642* (2013.01)

(58) Field of Classification Search

CPC ..... F24C 15/006; F24C 15/08; F24C 14/02; F24C 15/322; H05B 6/6402; H05B 6/642

USPC ..... 219/391, 393, 400, 402, 407, 680, 681, 219/685, 739, 756, 770, 757; 126/21 R, 126/21 A, 299 R, 275 R; 99/324, 339; 312/236

See application file for complete search history.

(56) References Cited

U.S. PATENT DOCUMENTS

| | | | | |
|---|---|---|---|---|
| 464,761 | A | 12/1891 | Detwiller | |
| 3,266,483 | A | 8/1966 | Keel | |
| 3,633,561 | A | 1/1972 | Barnett et al. | |
| 3,882,843 | A * | 5/1975 | Barnett | F24C 14/02 126/21 A |
| 3,911,893 | A * | 10/1975 | Baker | F24C 14/00 126/198 |
| 4,354,084 | A | 10/1982 | Husslein et al. | |

(Continued)

FOREIGN PATENT DOCUMENTS

| | | |
|---|---|---|
| DE | 10 2010 062147 A1 | 6/2011 |
| EP | 1 544 547 A1 | 6/2005 |

(Continued)

OTHER PUBLICATIONS

European Search Report dated Nov. 9, 2015 issued in corresponding European Patent Application 15173184.1.

(Continued)

*Primary Examiner* — Thien S Tran

(74) *Attorney, Agent, or Firm* — Staas & Halsey LLP

(57) ABSTRACT

An oven with an improved cooling structure is provided. The oven includes a casing; a cooking chamber located inside the casing and including a top plate forming the top, side plates forming both sides, a back plate forming the back, and a bottom plate forming the bottom; a panel located between the casing and the cooking chamber and spaced apart from the casing to form a fluid path for air to move; and a connection fluid path that guides the movement of air flowing from one side of the panel to the other side of the panel.

2 Claims, 10 Drawing Sheets

(56) References Cited

U.S. PATENT DOCUMENTS

| | | | | |
|---|---|---|---|---|
| 4,598,689 | A | 7/1986 | Eke | |
| 5,204,503 | A * | 4/1993 | Maiellano, Jr. | F24C 7/06 219/400 |
| 5,726,429 | A * | 3/1998 | Lim | H05B 6/6411 219/756 |
| 5,801,362 | A * | 9/1998 | Pearlman | A47J 37/0623 126/21 A |
| 2001/0004077 | A1 | 6/2001 | Lee et al. | |
| 2008/0149632 | A1* | 6/2008 | Kim | H05B 6/6435 219/757 |
| 2010/0139640 | A1 | 6/2010 | Watkins | |
| 2011/0052774 | A1 | 3/2011 | Sajjad et al. | |
| 2011/0276184 | A1 | 11/2011 | McKee et al. | |

FOREIGN PATENT DOCUMENTS

| | | | |
|---|---|---|---|
| EP | 1580488 | A1 | 9/2005 |
| FR | 2 935 780 | A1 | 3/2010 |
| GB | 2 056 826 | A | 3/1981 |

OTHER PUBLICATIONS

European Examination Report dated Apr. 26, 2017 in related European Patent Application No. 15173184.1.
European Communication under Rule 71(3) EPC dated May 9, 2018 in European Patent Application No. 15173184.1.

* cited by examiner

OVEN

CROSS-REFERENCE TO RELATED APPLICATIONS

This application claims the benefit under 35 U.S.C. § 119(a) of a Korean patent application filed on Jul. 23, 2014 in the Korean Intellectual Property Office and assigned Serial No. 10-2014-0093416, the entire disclosure of which is incorporated hereby incorporated by reference.

BACKGROUND

1. Field

The present disclosure relates to ovens, and more particularly to an oven with an improved cooling structure.

2. Description of the Related Art

Ovens are cooking appliances used for cooking a substance by sealing up and heating the substance, and may be generally be classified by their heat-source into electric, gas, and microwave ovens. Electric ovens use electric heaters as heat sources, and gas and microwave ovens use heat from gas and frictional heat of water molecules at high frequencies as heat sources, respectively.

The oven includes a cooking chamber for cooking, and a machine chamber for containing electrical and mechanical components. In the process of cooking, the cooking chamber is shut tight to prevent the internal high temperature heat from seeping out of the cooking chamber.

Many built-in ovens have recently been installed, in which case it is required to prevent the heat delivered from the oven from damaging adjacent furniture. Accordingly, a need exists for a technology to cool the oven to reduce the heat delivered from the oven.

Thus far, a method for cooling the oven by wrapping insulation around the cooking chamber has been used, in which case, however, there are limitations to expand volume of the cooking chamber.

SUMMARY

The present disclosure provides an oven to expand the size of its cooking chamber by minimizing thickness of insulation with an improved cooling structure of the oven.

In accordance with an aspect of the present disclosure, an oven is provided. The oven includes a casing; a cooking chamber located inside the casing and including a top plate forming the top, side plates forming both sides, a back plate forming the back, and a bottom plate forming the bottom; a panel located between the casing and the cooking chamber and spaced apart from the casing to form a fluid path for air to move; and a connection fluid path that guides the movement of air flowing from one side of the panel to the other side of the panel.

At least a part of the casing may have at least one flow-in hole formed for air to flow in from outside of the casing.

The casing may include side casing formed on both sides, a rear casing formed on the back, a top casing formed on the top, and a bottom casing combined with a bottom floor.

The flow-in hole may be located between a third and a fourth of the rear casing from the bottom.

The panel may include a back panel arranged to face the back plate of the cooking chamber, side panels arranged to face the side plates of the cooking chamber, and a top panel arranged to face the top plate of the cooking chamber.

The connection fluid path may include a first connection fluid path that runs from the back panel to the side panel.

The first connection fluid path may be at least one or more first slits formed at locations on the back panel adjacent to the side panel.

The connection fluid path may include a second connection fluid path that runs from the side panel to the top panel.

The second connection fluid path may be at least one or more second slits formed at locations on the top panel adjacent to the side panel.

The connection fluid path may include a third connection fluid path that runs from the back panel to the top panel.

The third connection fluid path may be at least one third slit formed at a location on the top panel adjacent to the back panel.

The oven may further include a cooling fan installed on the top panel and formed to suck in outdoor air.

In accordance with another aspect of the present disclosure, an oven is provided. The oven includes a casing; a cooking chamber located inside the casing; a flow-in hole formed on at least a part of the casing for outdoor air to flow to the inside of the casing; and at least one fluid path formed for air flowing in through the flow-in hole to move from the back of the cooking chamber the side of the cooking chamber.

The casing may include side casing formed on both sides, a rear casing formed on the back, a top casing formed on the top, and a bottom casing combined with a bottom floor.

The flow-in hole may include a first flow-in hole formed on the rear casing, and a second flow-in hole formed on the side casing.

The fluid path may include a first connection fluid path that runs from the back of the cooking chamber to the side of the cooking chamber, a second connection fluid path that runs from the side of the cooking chamber to the top of the cooking chamber, and a third connection fluid path that runs from the back of the cooking chamber to the top of the cooking chamber.

The oven may further include a panel located between the casing and the cooking chamber and spaced apart from the casing, and the connection fluid path may be formed on at least a part of the panel.

In accordance with another aspect of the present disclosure, an oven is provided. The oven includes a cooking chamber for cooking a substance; a casing forming an exterior shape and including side casing arranged on both sides of the cooking chamber, a rear casing arranged in the back of the cooking chamber, a top casing arranged on the top of the cooking chamber, and a bottom casing arranged on the bottom floor of the cooking chamber; and a panel located between the casing and the cooking chamber and including at least one connection fluid path for outdoor air to flow in and move around a space between the casing and the cooking chamber, wherein the connection fluid path is formed to guide movement of air flowing in from at least one side of the casing to a space between the other side of the casing and the panel.

The panel may include a back panel located in the back of the cooking chamber, side panels located on both sides of the cooking chamber, and a top panel located on the top of the cooking chamber, and the outdoor air may move from the back panel to the side panel through a first slit formed on at least a part of the back panel.

The air flowing in to the side panel may move to the top panel through a second slit formed at a location on the top panel adjacent to the side panel.

The air flowing in to the back panel may move to the top panel through a third slit formed at a location on the top panel adjacent to the back panel.

In accordance with another aspect of the present disclosure, an oven is provided. The oven includes a casing forming an external appearance of the oven, a cooking chamber disposed inside the casing and comprised of a top plate forming a top, two side plates forming both sides, a back plate forming a back, and a bottom plate forming a bottom of the cooking chamber, a back panel arranged to face the back plate of the cooking chamber, a side panel arranged to face one of the side plates of the cooking chamber, an opening formed in the casing to allow outdoor air to flow into the casing, an opening formed on the back panel to enable the outdoor air flowing into the casing to be moved over an outer surface of the back panel, and a fluid path that runs from the back panel to the side panel to guide the outdoor air flowing into the back panel through the opening formed on the back panel to move to a space between the casing and the side panel to cool the oven.

Other aspects, advantages, and salient features of the disclosure will become apparent to those skilled in the art from the following detailed description, which, taken in conjunction with the annexed drawings, discloses exemplary embodiments of the disclosure

BRIEF DESCRIPTION OF THE DRAWINGS

The above and other features and advantages of the present disclosure will become more apparent by describing in detail exemplary embodiments thereof with reference to the attached drawings in which.

Throughout the drawings, like reference numerals will be understood to refer to like parts, components, and structures.

DETAILED DESCRIPTION

Figure 1:
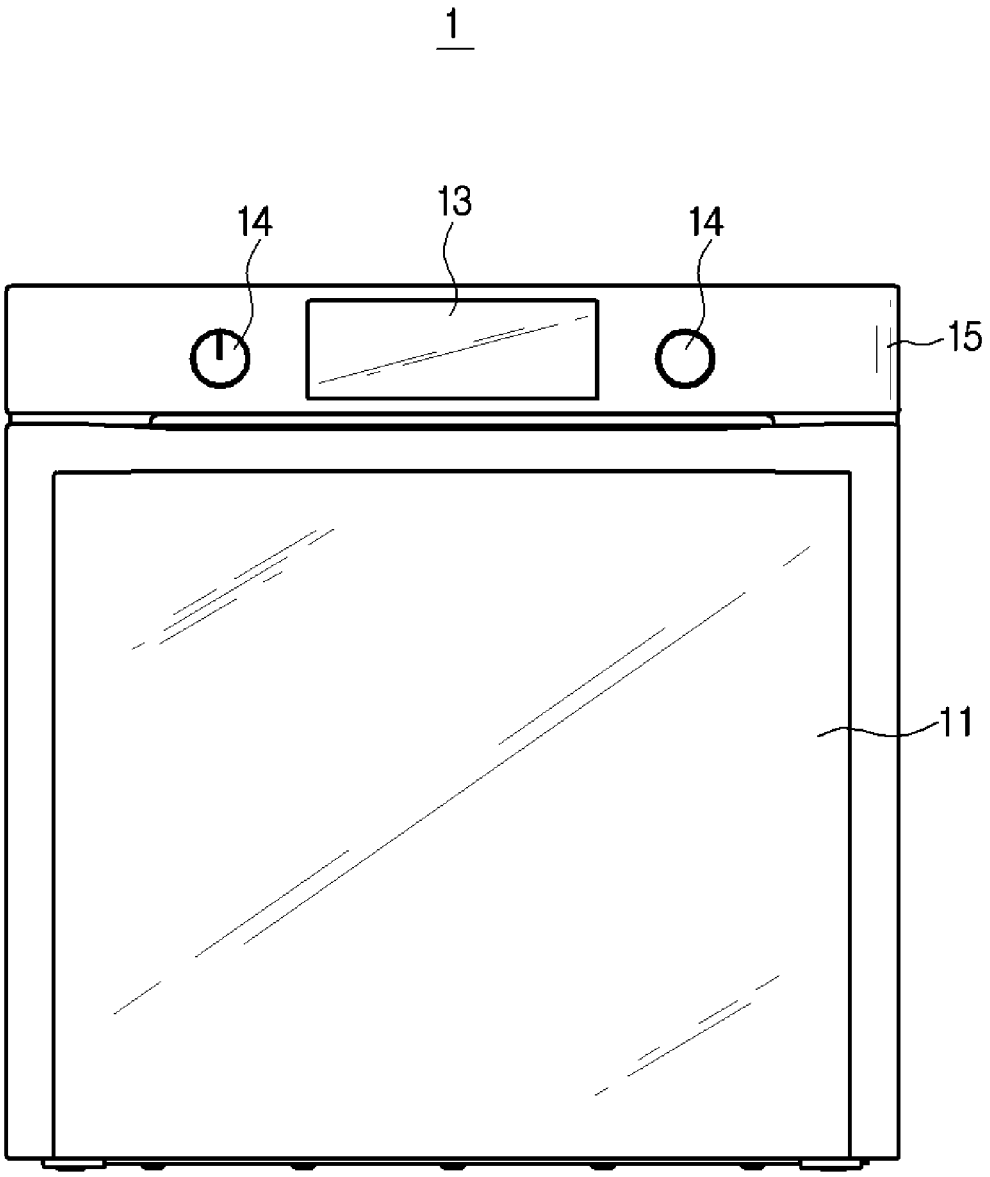
FIG. 1 is a front view of an oven, according to an embodiment of the present disclosure.

Reference will now be made in detail to embodiments, examples of which are illustrated in the accompanying drawings, wherein like reference numerals refer to the like elements throughout.

Figure 2:
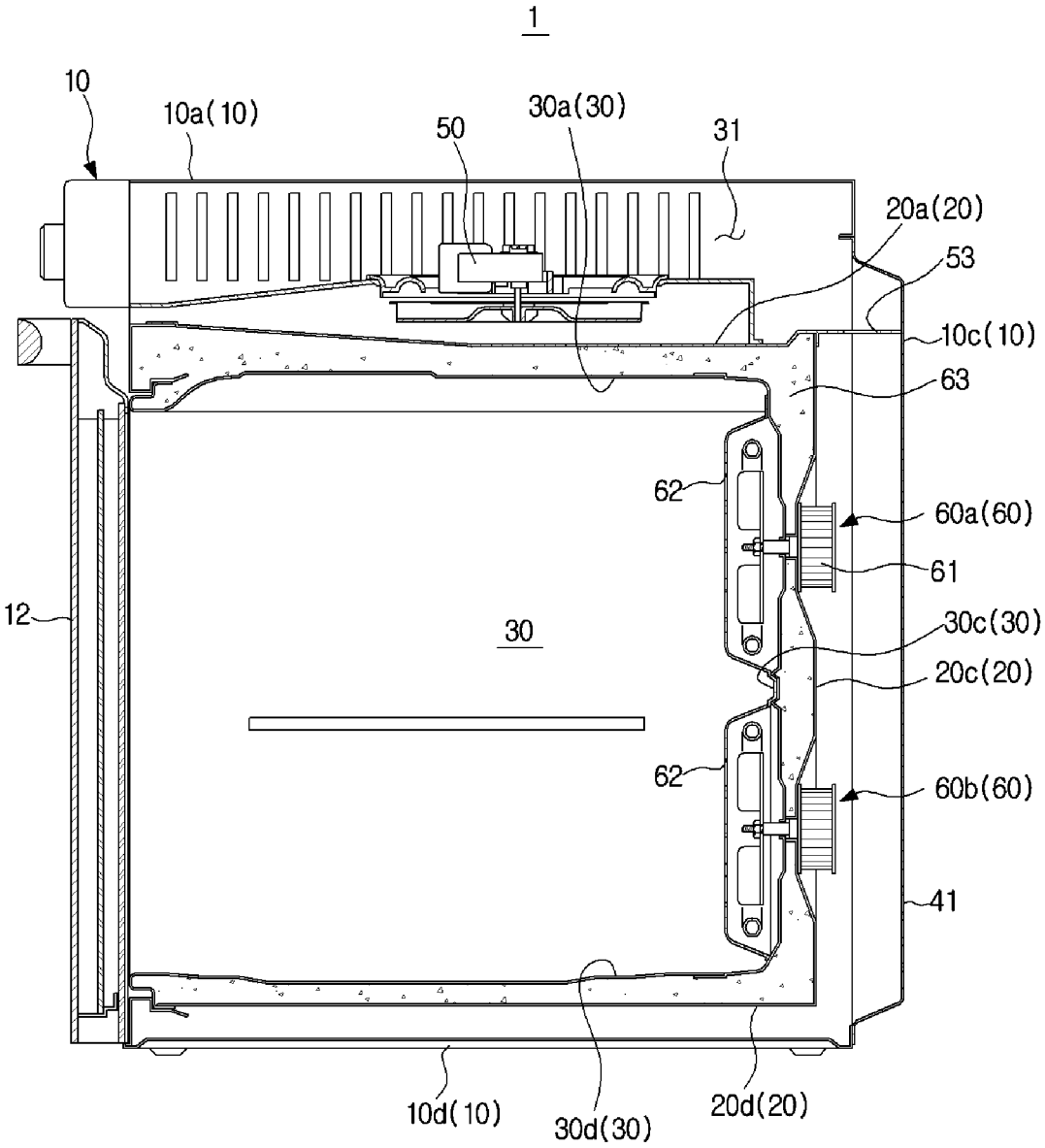
FIG. 2 is a side cross-sectional view of an oven, according to an embodiment of the present disclosure.

FIG. 1 is a front view of an oven, according to an embodiment of the present disclosure, and FIG. 2 is a side cross-sectional view of an oven, according to an embodiment of the present disclosure.

As shown in FIGS. 1 and 2, an oven 1 may include a casing 10 that forms the exterior shape, and a cooking chamber 30 located inside the casing 10.

The casing 10 may include a side casing 10*b* formed on both sides of the oven 1, a rear casing 10*c* formed in the back, a top casing 10*a* formed on the top, and a bottom casing 10*d* combined to the bottom floor.

The cooking chamber 30 may have the form of a box comprised of a top plate 30*a* forming the top, two side plates (not shown) forming the both sides, a back plate (30*c*) forming the back, and a bottom plate 30*d* forming the bottom. The front of the cooking chamber 30 may be open a substance such as food to be placed inside or taken out of the cooking chamber 30.

The open front of the cooking chamber 30 may be open or closed by a door 12 that is hinged with the cooking chamber 30 to be rotated up/downward. A handle may be formed on the door 12. Furthermore, at least a part of the door 12 may be formed of a transparent material in order for the cooking process performed in the cooking chamber 30 to be seen from outside.

A machine chamber 31 containing various mechanical and electrical parts such as circuit boards (not shown) may be arranged on top of the cooking chamber 30. A control panel 15 for controlling the machine chamber 31 may include a display 13 for displaying various operation information of the oven 1, and a controlling unit 14 for controlling the operation of the oven 1.

In addition, a rack (not shown) to place a cooking substance thereon such as a food to be cooked may be disposed inside the cooking chamber 30. Moreover, a plurality of supporters (not shown) may be arranged to install the rack. The supporters may be arranged to protrude from the left and right side walls of the cooking chamber 1.

At least one circulation fan unit 60 may be combined onto the back plate 30*c* of the cooking chamber 30. In an embodiment of the present disclosure, two circulation fan units 60 are combined onto the back plate 30*c* of the cooking chamber 30. Each circulation fan unit 60 may include a circulation motor 61 and a circulation fan 63. A circulation fan cover 62 formed of flat-typed members may cover the circulation fan 63. One or more through holes (not shown) may be formed on the circulation fan cover 62. With the through holes, a fluid that passed by the circulation fan 63 may move into the cooking chamber 30 through the through holes.

A cooling fan unit 50 may be installed in the machine chamber 31 to cool off the inside of the machine chamber 31. The cooling fan unit 50 may suck outdoor air into the machine chamber 31 and then discharge the air forward of the oven 1. The cooking chamber 30 and the cooling fan unit 50 may be connected to each other via a separate fluid path (not shown). During the process of cooking a substance, at least a part of a fluid of the cooking chamber 30 may flow into the cooling fan unit 60 through the fluid path and then be discharged forward of the oven 1. In an embodiment of the present disclosure, a cooling fan of the cooling fan unit 50 may be formed as a centrifugal fan. However, it is not limited thereto, and may be implemented as a cross-flow fan or a propeller fan.

A panel 20 may be situated between the casing 10 and the cooking chamber 30. The panel 20 may be positioned to be spaced apart from the casing 10. This may enable a fluid path for air flow to be formed between the casing 10 and the panel 20.

The panel 20 may be comprised of a back panel 20*c* arranged to face the back plate 30*c* of the cooking chamber 30, side panels 20*b* arranged to face the side plates (not shown) of the cooking chamber 30, and a top panel 20*a* arranged to face the top plate 30*a* of the cooking chamber 30. At least one slit 51*a*, 52*a*, 53*a* may be formed on at least a part of the panel 20, which enables the air to be moved over the outer surface of the panel 20. This will be described in more detail later.

Insulation 63 may be situated between the cooking chamber 30 and the panel 20. Specifically, the insulation 63 may be filled between the top plate 30*a* and the top panel 20*a*, the back plate 30*c* and the back panel 20*c*, the side plates and the side panels (20*b*), and the bottom plate 30*d* and a bottom panel 20*d*. The insulation 63 may prevent heat inside the cooking chamber 30 from being delivered into the machine chamber 31 and to the outside of the oven 1.

An opening such as a flow-in hole 41 may be formed in the rear casing 10*c* to allow outdoor air to flow into the casing 10. This will be described in more detail later.

Figure 3:
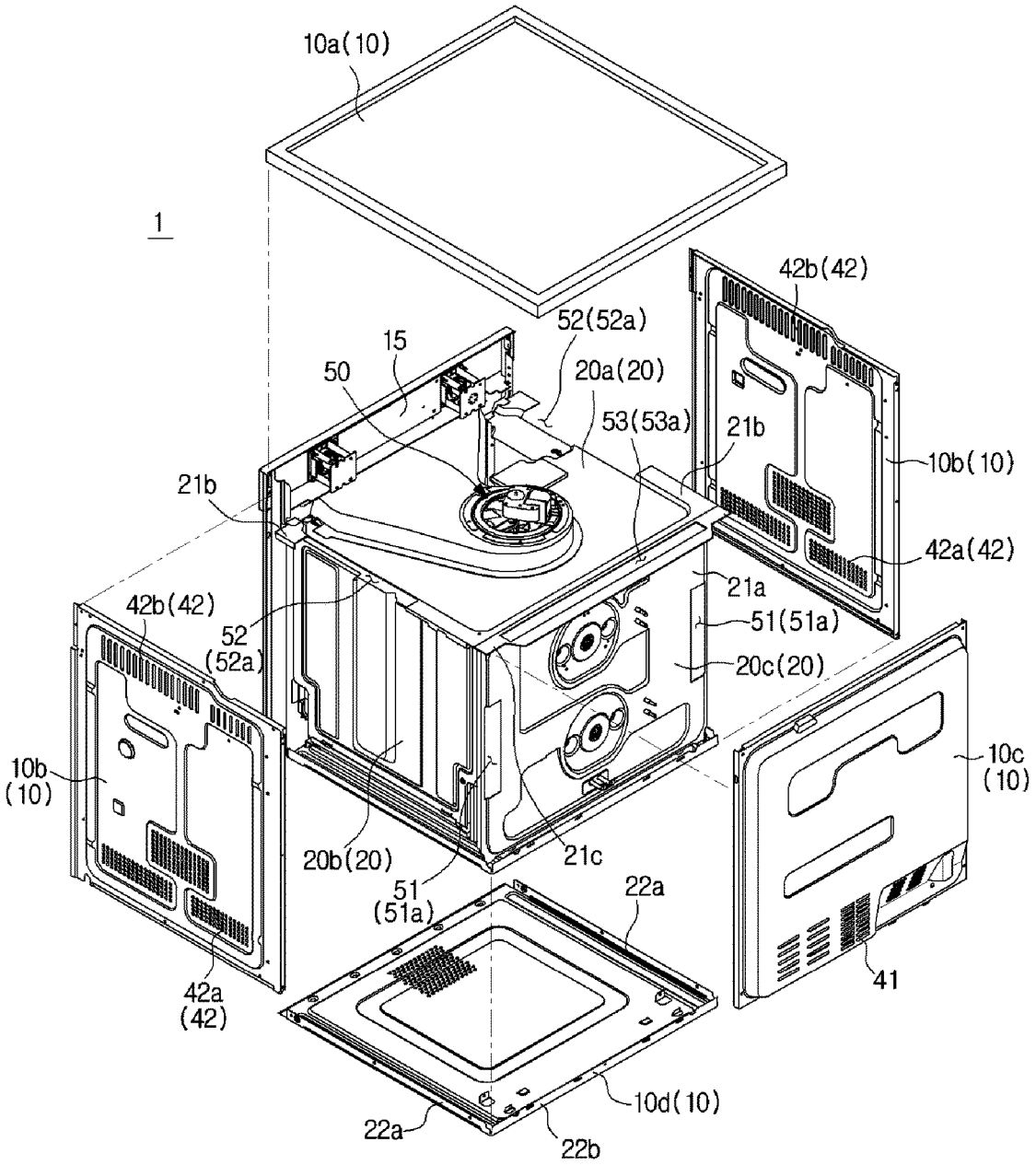
FIG. 3 is an exploded view of an oven with disassembled casing, according to an embodiment of the present disclosure.

FIG. 3 is an exploded view of an oven with disassembled casing, according to an embodiment of the present disclosure.

As shown in FIG. 3, the oven 1 may include the casing 10 and the panel 20 arranged inside the casing 10. The cooking chamber 30 may be located inside the panel 20.

At least one opening such as a flow-in hole 41, 42 may be formed in at least a part of the casing 10 in order for the outdoor air to flow to the inside of the casing 10. In an embodiment of the present disclosure, a first flow-in hole 41 may be formed on the rear casing 10*c*. A second flow-in hole 42 may be formed on the side casing 10*b*. This will be described in more detail later.

At least one opening such as slit 51*a*, 52*a*, 53*a* may be formed on at least a part of the panel 20 for the outdoor air to flow into the fluid path formed between the casing 10 and the panel 20 and move around the panel 20. The slits 51*a*, 52*a*, 53*a* may include a first slit 51*a*, a second slit 52*a*, and a third slit 53*a*, which will be described in more detail later.

A first projection 21*b* may be formed to protrude outward from an edge of the top panel 20*a* adjacent to the side panel 20*b*. A second projection 21*c* may also be formed to protrude outward from an edge of the top panel 20*a* adjacent to the back panel 20*c*.

On the bottom casing 10*d*, there may be ribs 22*a*, 22*b* projecting upward to be combined with the side casing 10*b* and the rear casing 10*c*. The first rib 22*a* may be combined with the side casing 10*b* on its outside, and the second rib 22*b* may be combined with the rear casing 10*c* on its outside. The side casing 10*b* and the rear casing 10*c* may be combined with the bottom casing 10*d* by way of separate coupling members, such as screws (not shown).

Figure 4:
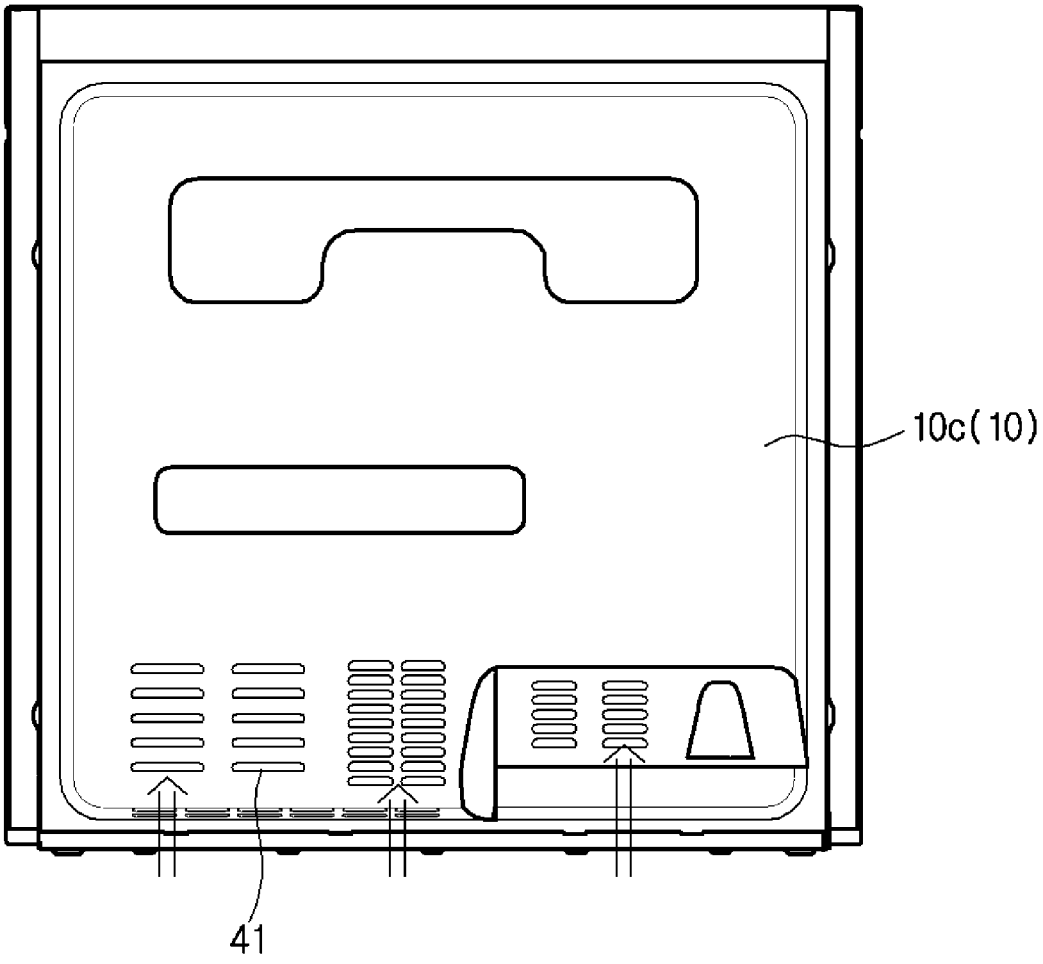
FIG. 4 is a rear casing of an oven, according to an embodiment of the present disclosure.
Figure 5:
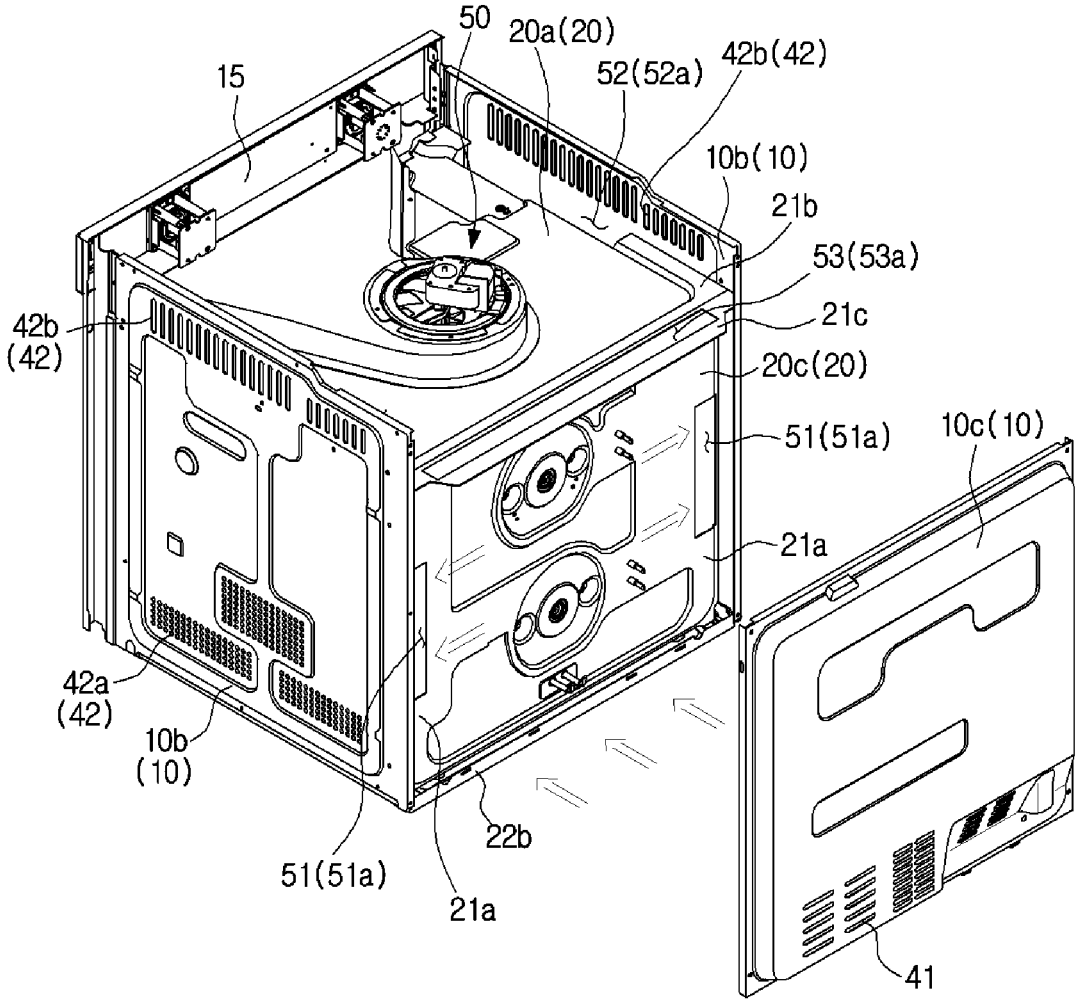
FIG. 5 shows an oven with a disassembled rear casing, according to an embodiment of the present disclosure.

FIG. 4 is a rear casing of an oven, according to an embodiment of the present disclosure, and FIG. 5 shows an oven with a disassembled rear casing, according to an embodiment of the present disclosure.

As shown in FIGS. 4 and 5, the first flow-in hole 41 may be formed on the rear casing 10*c* to suck the outdoor air in. The first flow-in hole 41 may be situated between a third and a fourth of the way from the bottom of the rear casing 10*c*. This is to guide the outdoor air into the lower part of the oven 1. In other words, this enables the air flowing in not only to move around the rear side of the casing 10 and the panel 20 but also to efficiently move up and to the sides between the casing 10 and the panel 20.

The fluid path for the air flowing in from outside to move between the casing 10 and the panel 20 may include a first connection fluid path 51 that runs from the back panel 20*c* to the side panel 20*b*. The first connection fluid path 51 may be formed to cause the air flowing in to the back panel 20*c* to move to the side panel 20*b*. The first connection fluid path 51 may have the form of a slit, which is defined herein as a first slit 51*a*. In an embodiment of the present disclosure, at least one or more first slits 51*a* may be formed at locations of the back panel 20*c* adjacent to the side panel 20*b*. There are a total of two first slits 51*a* formed on the side of the back panel 20*c*. However, locations where the first slits 51*a* are to be formed are not limited thereto, and they may be formed at locations of the side panel 20*b* adjacent to the back panel 20*c*. Alternatively, instead of the first slit 51*a*, a fluid path may be formed by extending a pipe from the first flow-in hole 41 such that air may flow from the back panel 20*c* to the side panel 20*b*.

Figure 6:
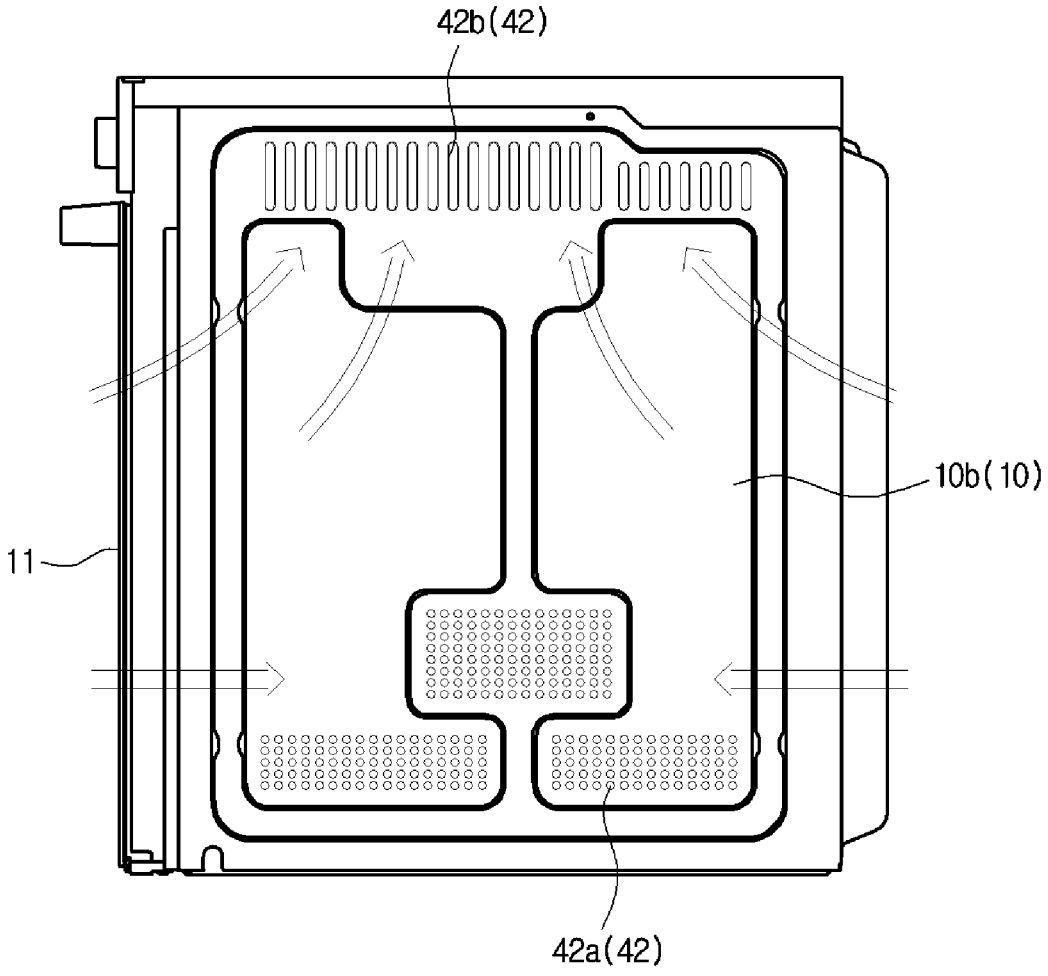
FIG. 6 is a side casing of an oven, according to an embodiment of the present disclosure.
Figure 7:
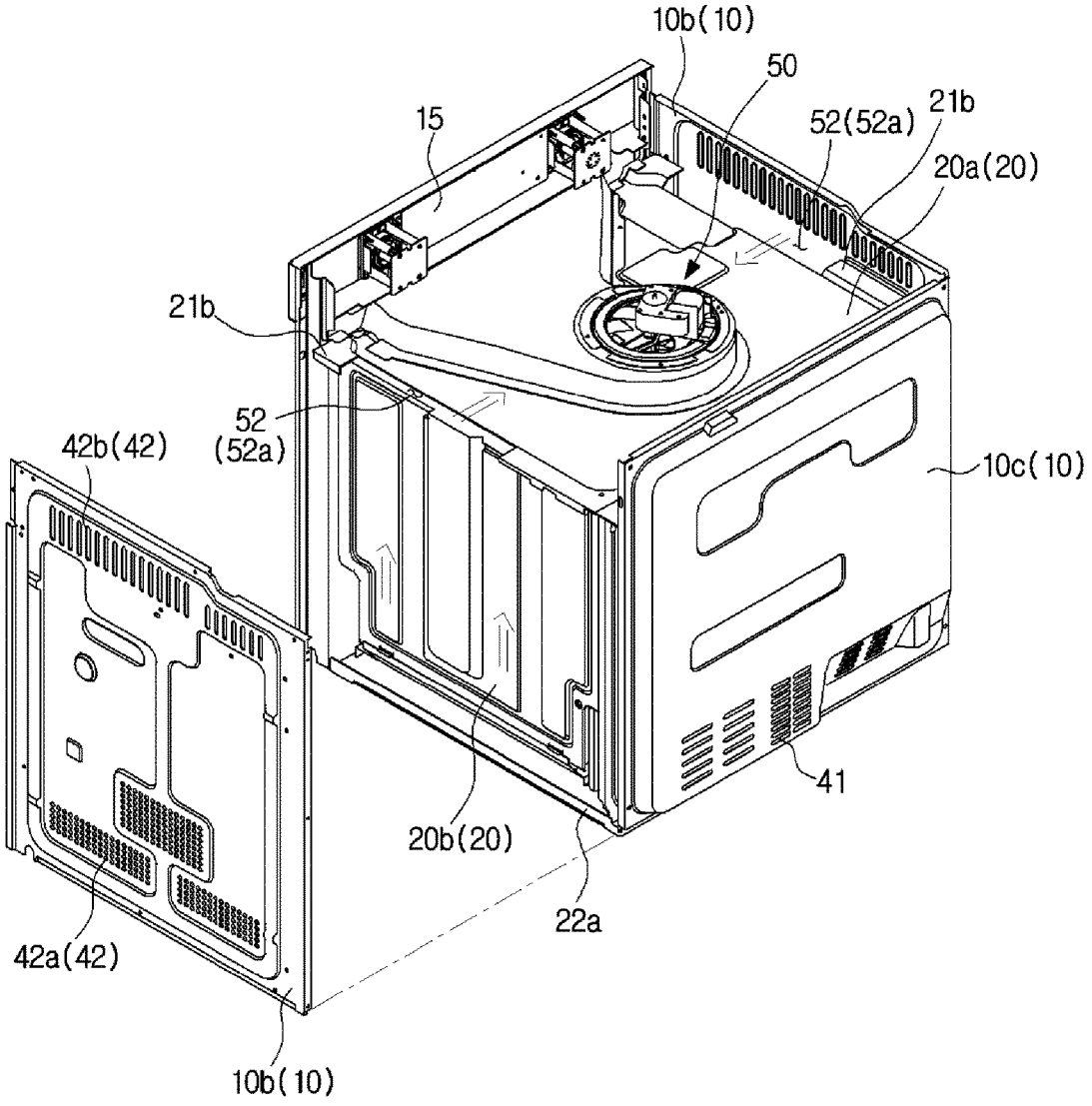
FIG. 7 shows an oven with a disassembled side casing, according to an embodiment of the present disclosure.
Figure 8:
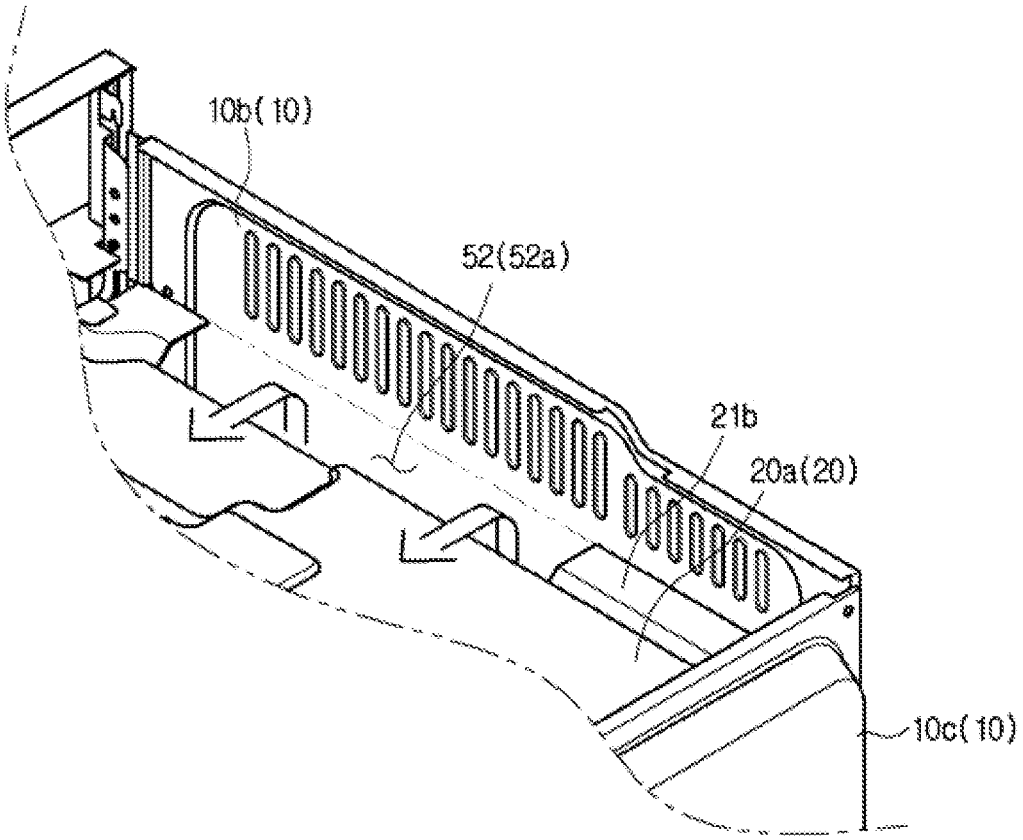
FIG. 8 is a disassembled top casing of an oven, according to an embodiment of the present disclosure.

FIG. 6 is a side casing of an oven, according to an embodiment of the present disclosure, FIG. 7 shows an oven with a disassembled side casing, according to an embodiment of the present disclosure, and FIG. 8 is a disassembled top casing of an oven, according to an embodiment of the present disclosure.

As shown in FIGS. 6 to 8, the second flow-in hole 42 may be formed on at least a part of the side casing 10*b* to make the outdoor air flow to the inside of the casing 10. The second flow-in hole 42 may include a second flow-in lower hole 42*a* formed on a lower part of the side casing 10*b*, and a second flow-in upper hole 42*b* formed on an upper part of the side casing 10*b*.

The air flowing through the second flow-in lower and upper holes 42*a* and 42*b* may move to the top panel 20*a* through a fluid path. The fluid path for the air to move from the side panel 20*b* to the top panel 20*a* is defined as a second connection fluid path 52. The second connection fluid path 52 may have the form of a slit, which is defined herein as a second slit 52*a*. In an embodiment of the present disclosure, at least one or more second slits 52*a* may be formed at locations of the top panel 20*a* adjacent to the side panel 20*b*.

In another embodiment of the present disclosure, the second slit 52*a* may be formed by cutting at least a part of the first projection 21*b* formed to protrude from the top panel 20*a* in the direction of the side casing 10*b*. In yet another embodiment of the present disclosure, the second slit 52*a* may be formed by cutting the tip of the first projection 21*b*. Especially, in still another embodiment of the present disclosure, the second slit 52*a* may be formed in the center of the tip of the first projection 21*b*. Since the first projection 21*b* is formed to protrude relative to the side panel 20*b*, the air flowing in to the side panel 20*b* from outside and the air flowing in to the side panel 20*b* from the back panel 20*c* may move to the top panel 20*a* through the second slit 52*a*. It is, however, not limited thereto, and the second slit 52*a* may be formed on a location of the side panel 20*b* adjacent to the top panel 20*a*.

Figure 9:
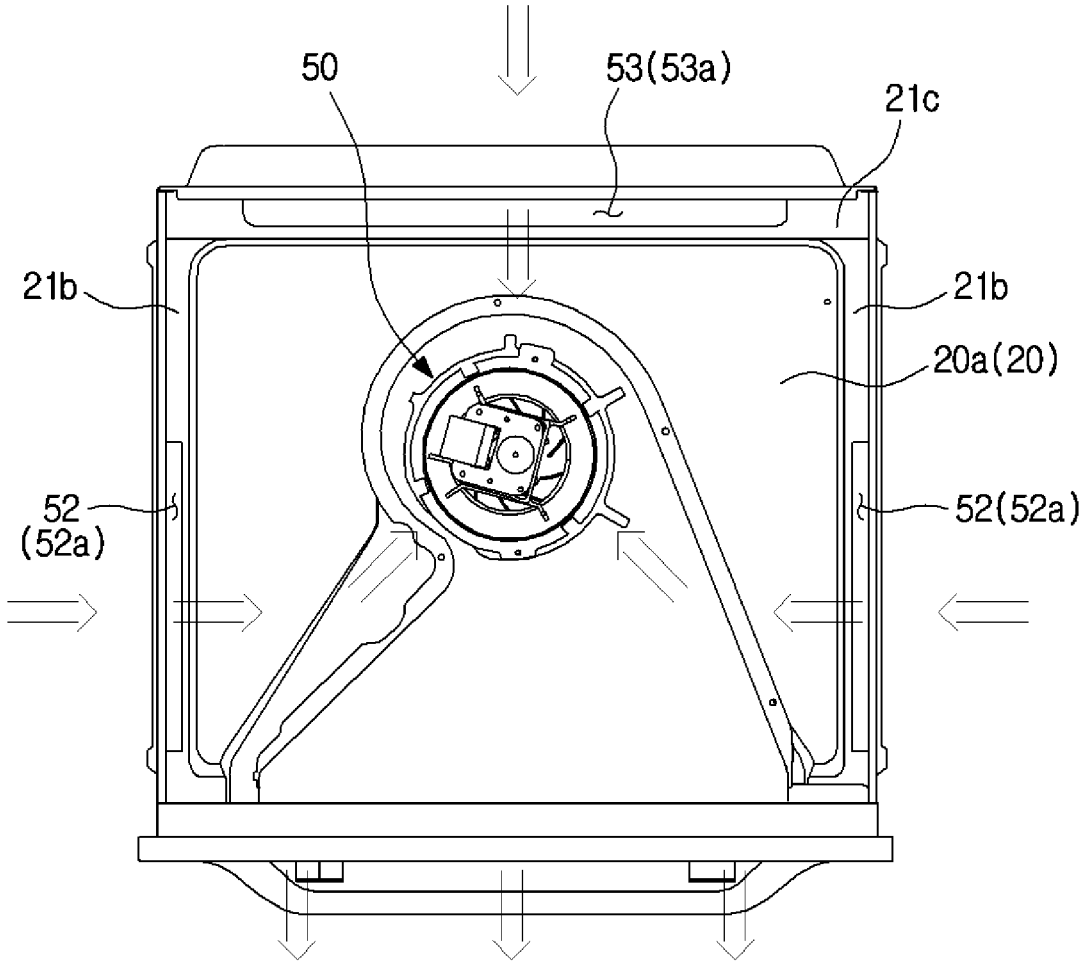
FIG. 9 shows a top panel of an oven with a disassembled top casing, according to an embodiment of the present disclosure.

FIG. 9 shows a top panel of an oven with a disassembled top casing, according to an embodiment of the present disclosure.

As shown in FIG. 9, a fluid path may be formed on the top panel 20*a* for the air from the side and back panels 20*b* and 20*c* to flow. The fluid path formed for the air to move from the side panel 20*b* to the top panel 20*a* is defined as the second connection fluid path 52. The fluid path formed for the air to move from the back panel 20*c* to the top panel 20*a* is defined as a third connection fluid path 53.

As discussed above, the second connection fluid path 52 may have the form of the second slit 52*a*, or may be formed by cutting the first projection 21*b* of the top panel 20*a*.

The third connection fluid path 53 may have the form of a slit, which is defined herein as a third slit 53*a*. In an embodiment of the present disclosure, the third slit 53*a* may be formed at a location of the top panel 20*a* adjacent to the back panel 20*c*. More specifically, the third slit 53*a* may be formed by cutting at least a part of the second projection 21*c* formed to protrude outward from the top panel 20*a*. In another embodiment of the present disclosure, the third slit 53*a* may be formed by cutting the center part of the second projection 21*c* rather than the outer part.

In an embodiment of the present disclosure, the circulation fan of the circulation fan unit 50 may be formed as a centrifugal fan. In this case, the air that has flowed to the top panel 20*a* through the respective connection fluid paths may flow in to both sides and to the back of the centrifugal fan. The air flowing in may be discharged through the front side of the centrifugal fan and thus through the front side of the oven 1.

In a case the circulation fan of the circulation fan unit 50 is formed as a mixed flow fan, air may flow in from the back of the mixed flow fan and be discharged forward. Alternatively, the circulation fan of the circulation fan unit 50 may be implemented as a propeller fan.

Figure 10:
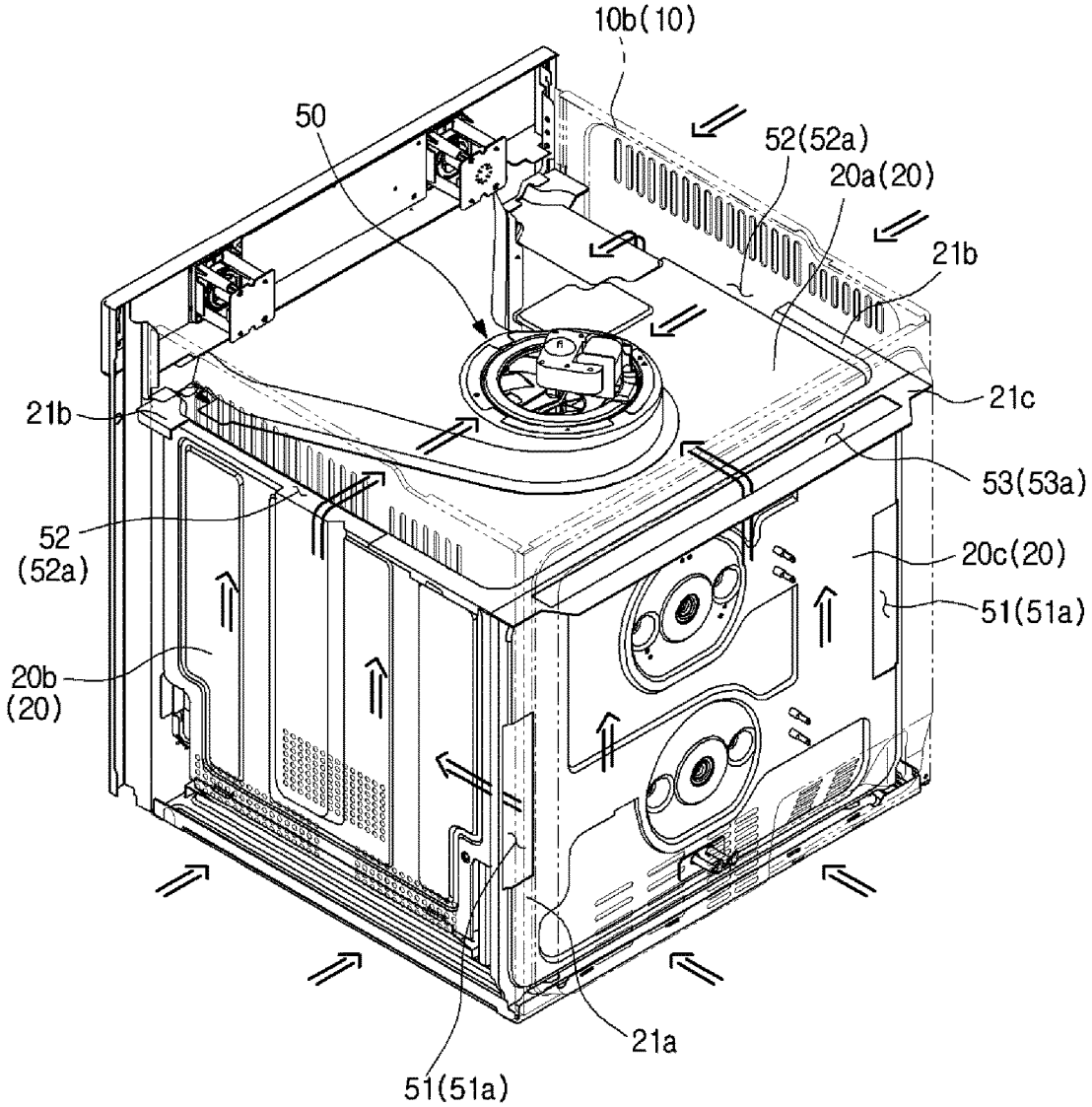
FIG. 10 shows an air flow-in structure of an oven, according to an embodiment of the present disclosure.

FIG. 10 shows an air flow-in structure of an oven, according to an embodiment of the present disclosure.

As shown in FIG. 10, the outdoor air may flow in through the rear casing 10*c* or the side casing 10*b*.

The air flowing in through the rear casing 10*c* may flow in between the side casing 10*b* and the side panel 20*b* through the first slit 51*a*, or between the top casing 10*a* and the top panel 20*a* through the third slit 53*a*.

The air flowing to the inside of the oven 1 through the side casing 10*b* and the air flowing in between the side casing 10*b* and the side panel 20*b* through the first slit 51*a* may flow in between the top casing 10*a* and the top panel 20*a* through the second slit 52*a*.

Since the air flowing to the inside of the rear casing 10*c* immediately flows to the top casing 10*a* and the top panel 20*a* in the conventional ovens, sides of the oven 1 are hardly cooled. However, in the embodiments of the present disclosure, a fluid path for air flow may be formed between the casing 10 and the panel 20. More specifically, the first slit 51*a* formed on the rear casing 10*c* enables the air to move from between the rear casing 10*c* and the back panel 20*b* to between the side casing 10*b* and the side panel 20*b*, thereby efficiently cooling the sides of the oven 1. This may lead to prevention of damage to adjacent furniture due to heat delivered from the sides of the oven 1. Particularly, lots of power is required to cool off the heat generated on the surface of the oven 1 in ordinary cases, but in the embodiments of the present disclosure, not as much power is required because of the fluid path(s) and thus the oven may be efficiently cooled off.

Since the air flowing to the inside of the rear casing 10*c* moves between the side casing 10*b* and the side panel 20*b*, the first flow-in hole 41 may be situated between a third and a fourth of the rear casing 10*c* from the bottom so as to reduce the capacity of air flowing to the upper part of the rear casing 10*c* to make the air efficiently flow to the lower part of the rear casing 10*c*.

In the embodiments of the present disclosure, both sides of the oven 1 may be cooled down by a temperature of 30 to 40° C. Accordingly, it is possible to manufacture the oven 1 with the insulation 63 located outside of the cooking chamber 30 being thinner than before. For example, although the conventional oven has about 25 mm thick insulation, the oven according to the embodiments of the present disclosure may have insulation reduced by about 5 mm down to about 20 mm thick. The space formed between the casing 10 and the panel 20 to prevent damage to adjacent furniture may be reduced as well. For example, although the conventional oven has about 15 mm wide space between the casing 10 and the panel 20, the oven according to the embodiments of the present disclosure may only need to form about 8 mm wide space between the casing 10 and the panel 20, thus reducing the width of the space by about 7 mm as compared to the conventional case. As the thickness of the insulation 63 decreases, the volume of the cooking chamber 30 of the oven 1 may increase as compared with the conventional oven with the same size. For example, while the conventional cooking chamber has the volume of about 70 L, the cooking chamber 30 in accordance with the embodiments of the present disclosure may have the volume of about 76 L to 80 L, thereby increased by up to 10 L from the conventional cooking chamber. Furthermore, in accordance with the present disclosure, the outdoor air flowing in may move between the casing 10 and the panel 20, thereby preventing a temperature rise of the components located within the machine chamber 31 to more than a certain temperature. While the components of the conventional machine chamber 31 have the temperature of about 75° C., the components of the machine chamber 31 of the oven 1 in accordance with the present disclosure may have the temperature of about 60° C. decreased by 15° C. compared with the conventional case.

According to embodiments of the present disclosure, with an improved cooling structure of air circulation inside an oven, thickness of insulation may be reduced, thus leading to increased volume of the cooking chamber. Furthermore, the improved cooling structure may enable outdoor air flowing in to reduce the temperature of the machine chamber by cooling, thereby increasing durability of components of the oven.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. An oven comprising:

a casing forming an external appearance of the oven, and including:

a left side casing including a left side casing air flow hole in a lower portion of the left side casing for air to flow from an outside of the casing to an inside of the casing;

a right side casing including a right side casing air flow hole in a lower portion of the right side casing for air to flow from the outside of the casing to the inside of the casing;

a rear casing including a rear casing air flow hole in a lower portion of the rear side casing for air to flow from the outside of the casing to the inside of the casing;

a cooking chamber located inside the casing; and panels located between the casing and the cooking chamber, and spaced apart from the casing to form a fluid path for air to move between the panels and the casing, the panels including a left side panel, a right side panel, and a rear panel including a rear panel left side hole to guide air flowing over the rear panel from the rear casing air flow hole into air flowing over the left side panel from the left side casing air flow hole, and a rear panel right side hole to guide air flowing over the rear panel from the rear casing air flow hole into air flowing over the right side panel from the right side casing air flow hole.

2. The oven of claim 1, further comprising:

a cooling fan installed in an upper portion of the oven and configured to suck in air from the outside of the casing through the left side casing air flow hole, the right side casing air flow hole, and the rear casing air flow hole.

* * * * *